US005924397A

United States Patent [19]

Moriya et al.

[11] Patent Number: 5,924,397

[45] Date of Patent: Jul. 20, 1999

[54] VARIABLE VALVE PERFORMANCE APPARATUS FOR ENGINE

[75] Inventors: Yoshihito Moriya, Nagoya; Kiyoshi Sugimoto, Okazaki; Tadao Hasegawa, Toyota, all of Japan

[73] Assignee: Toyota Jidosha Kabushiki Kaisha, Toyota, Japan

[21] Appl. No.: 08/972,572

[22] Filed: Nov. 18, 1997

[30] Foreign Application Priority Data

Nov. 19, 1996 [JP] Japan ..... 8-308129
Jun. 25, 1997 [JP] Japan ..... 9-168891

[51] Int. Cl.[6] ..... F01L 13/00; F01L 1/34; F02D 13/02

[52] U.S. Cl. ..... 123/90.18; 123/90.17; 73/116; 73/117.3

[58] Field of Search ..... 123/90.15, 90.17, 123/90.18, 90.31; 73/116, 117.2, 117.3, 118.1

[56] References Cited

U.S. PATENT DOCUMENTS 4,494,506 1/1985 Hayama et al. ..... 123/90.18
4,708,101 11/1987 Hara et al. ..... 123/90.18
5,611,304 3/1997 Shinojima ..... 123/90.17

FOREIGN PATENT DOCUMENTS 384 361 8/1990 European Pat. Off. .
443 514 8/1991 European Pat. Off. .
590 577 4/1994 European Pat. Off. .
4-187807 7/1992 Japan .
6-10106 1/1994 Japan .
7-26920 1/1995 Japan .
7-139327 5/1995 Japan .
2 221 306 1/1990 United Kingdom .

OTHER PUBLICATIONS

910009 The Variable Valve Timing System–Application on a V8 Engine, A. Titolo, Fiat Auto, 1991 Winner of the charles Deutsch Prize, pp. 8–15.

*Primary Examiner*—Weilun Lo
*Attorney, Agent, or Firm*—Pillsbury Madison & Sutro LLP

[57] ABSTRACT

An apparatus for controlling valve performance in an engine is disclosed. A first detection blade helically extends on a camshaft. A pair of second detection blades are located on the camshaft and extend axially on the camshaft. An electromagnetic pickup is arranged to face the camshaft. The pickup produces a pulse in response to one of the blades passing by the pickup when the camshaft rotates. ECU computes the axial position of the camshaft based on the change in the time period from the pulse corresponding to the second blade to the pulse corresponding to the first blade.

15 Claims, 12 Drawing Sheets

VARIABLE VALVE PERFORMANCE APPARATUS FOR ENGINE

BACKGROUND OF THE INVENTION

The present invention relates to a variable valve performance apparatus for varying performance of a set of intake valves or a set of exhaust valves provided on a camshaft of an engine by moving cams that have changing cam profiles along the axis of the camshaft. More particularly, the present invention pertains to an improvement of an apparatus that feedback controls the movement of cams based on the position of the cams detected by a sensor.

Many existing engines are equipped with an apparatus that varies the performance characteristics of a set of intake valves or a set of exhaust valves as necessary. This enhances the power and performance of the engine and reduces undesirable emissions. Japanese Unexamined Patent Publication No. 4-187807 discloses such a variable valve performance apparatus. FIG. 17 is a schematic view of this apparatus.

As shown in FIG. 17, a variable valve performance apparatus 101 is provided on a cylinder head 102 of an engine. The cylinder head 102 has an intake passage 103, which is connected to a combustion chamber (not shown). An intake valve 104 is located in the intake passage 103. The valve 104 selectively connects and disconnects the combustion chamber with the passage 103. The mechanism 101 varies the performance of the valve 104.

The apparatus 101 includes a camshaft 105, a cam 106 and a cam moving mechanism 107 located above the cylinder head 102. The cam 106 is located on the camshaft 105 and is moved along the axis of the camshaft 105 by the cam moving mechanism 107.

The camshaft 105 is rotated by a crankshaft (not shown) of the engine. The cam 106 contacts the upper end of the valve 104. The cam 106 slides along the axis of the camshaft 105 and rotates integrally with the camshaft 105. The profile of the cam 106 continuously changes along the axial direction of the camshaft 105 as shown FIG. 18.

When rotating integrally with the camshaft 105, the cam 106 causes the intake valve 104 to open and close. Moving the cam 106 in the direction of arrow Q gradually advances the opening timing of the valve 104, prolongs the duration of opening of the valve 104 and increases the lift of the valve 104. Moving the cam 106 in a direction of an arrow P gradually retards the opening timing of the valve 104, shortens the duration of opening of the valve 104 and decreases the lift of the valve 104.

Such changes of valve performance are usually performed in the following manner. When the engine speed is low, the opening duration of the valve 104 is shortened and the lift of the valve 104 is decreased for stabilizing the engine speed and for enhancing the engine torque. As a result, the speed of air-fuel mixture, when being drawn into the combustion chamber, is increased. When the engine speed is high, the opening duration of the valve 104 is prolonged and the lift of the valve 104 is increased for increasing the power of the engine. As a result, the amount of air-fuel mixture drawn into the combustion chamber is increased.

The cam moving mechanism 107 includes an arm 108, a screw rod 109 and a control motor 110. The arm 108 holds the cam 106 by contacting the cam 106 at both ends. The screw rod 109 extends parallel to the cam shaft 105. The arm 108 is screwed on the rod 109. The control motor 110 rotates the rod 109 thereby causing the arm 108 to move along the rod 109. Accordingly, the cam 106, which is held by the arm 108, moves along the axis of the camshaft 105.

The control motor 110 is controlled by a controller 111. The controller 111 receives detection signals from an engine speed sensor 115 and other sensors 112 that detect the running state of the engine. The controller 111 controls the motor 110 based on the inputted signals. The controller 111 also receives detection signals from a cam position sensor 116, which detects the position of the cam 106, and feedback controls the motor 110 based on the signals indicating the cam position. As a result, an optimum cam profile is selected in accordance with the running state of the engine.

A gap sensor may be used as the cam position sensor 116. The gap sensor includes a coil that generates induced electromotive force in accordance with the position of a cam. The gap sensor outputs the generated induced electromotive force as a detection signal. However, the gap sensor has a relatively limited range of accurate position detection. It is therefore difficult for the gap sensor to accurately detect the position of the cam along the entire movable range of the cam.

The gap sensor may be replaced with an optical sensor. However, engine vibrations and grime degrade the detection accuracy of the optical sensor. Thus, the optical sensor is not reliable.

If the position of a cam is not accurately detected, it is difficult to optimize the cam profile in accordance with the running condition of the engine.

SUMMARY OF THE INVENTION

Accordingly, it is an objective of the present invention to provide a variable valve performance mechanism of an engine that accurately detects the position of a cam and optimizes the position of the cam in accordance with the running state of the engine.

To achieve the above objective, the present invention provides an apparatus for controlling valve performance in an engine. The engine includes a valve for opening and closing a combustion chamber. The valve is actuated with a variable valve performance including at least one of a variable valve lift amount and a variable valve timing. The apparatus comprises a camshaft and a cam provided on the camshaft for integrally rotating with the camshaft to selectively open and close the valve. The cam has a cam surface for slidably contacting the valve. The cam surface has a profile that varies axially. The apparatus has an axial drive mechanism for moving the cam axially to change the valve performance. The axial movement of the cam changes the axial position of a point on the cam surface with respect to the valve. A detection element extends generally in the axial direction of the camshaft. The detection element is arranged to extend along a path that is different from the path of movement followed by a point on the cam when the cam is moved by the axial drive mechanism. A pulser produces a pulse in response to the detection element passing by the pulser when the camshaft rotates. A computer computes the change of axial position of the cam produced by the axial drive mechanism based on a corresponding change of the time at which the pulser produces the pulse as measured from a reference time.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

FIG. 4(*b*) is a side view illustrating the pickup and the detection blades of FIG. 4(*a*);

FIG. 5(*b*) is side view illustrating the pickup and the first and second detection blades of FIG. 5(*a*);

FIG. 10(*b*) is a side view illustrating the pickup and the detection blades of FIG. 10(*a*);

FIG. 12(*b*) is a side view illustrating the pickup and the detection blades of FIG. 12(*a*);

FIG. 15(*b*) is a side view illustrating the detection blades of FIG. 15(*a*);

FIG. 16(*b*) is a side view illustrating the detection blades of FIG. 16(*a*);

DETAILED DESCRIPTION OF THE PREFERRED EMBODIMENTS

An apparatus for varying valve performance according to a first embodiment of the present invention will now be described with reference to FIGS. 1 to 7. The apparatus is incorporated in an in-line four cylinder type engine.

Figure 1:
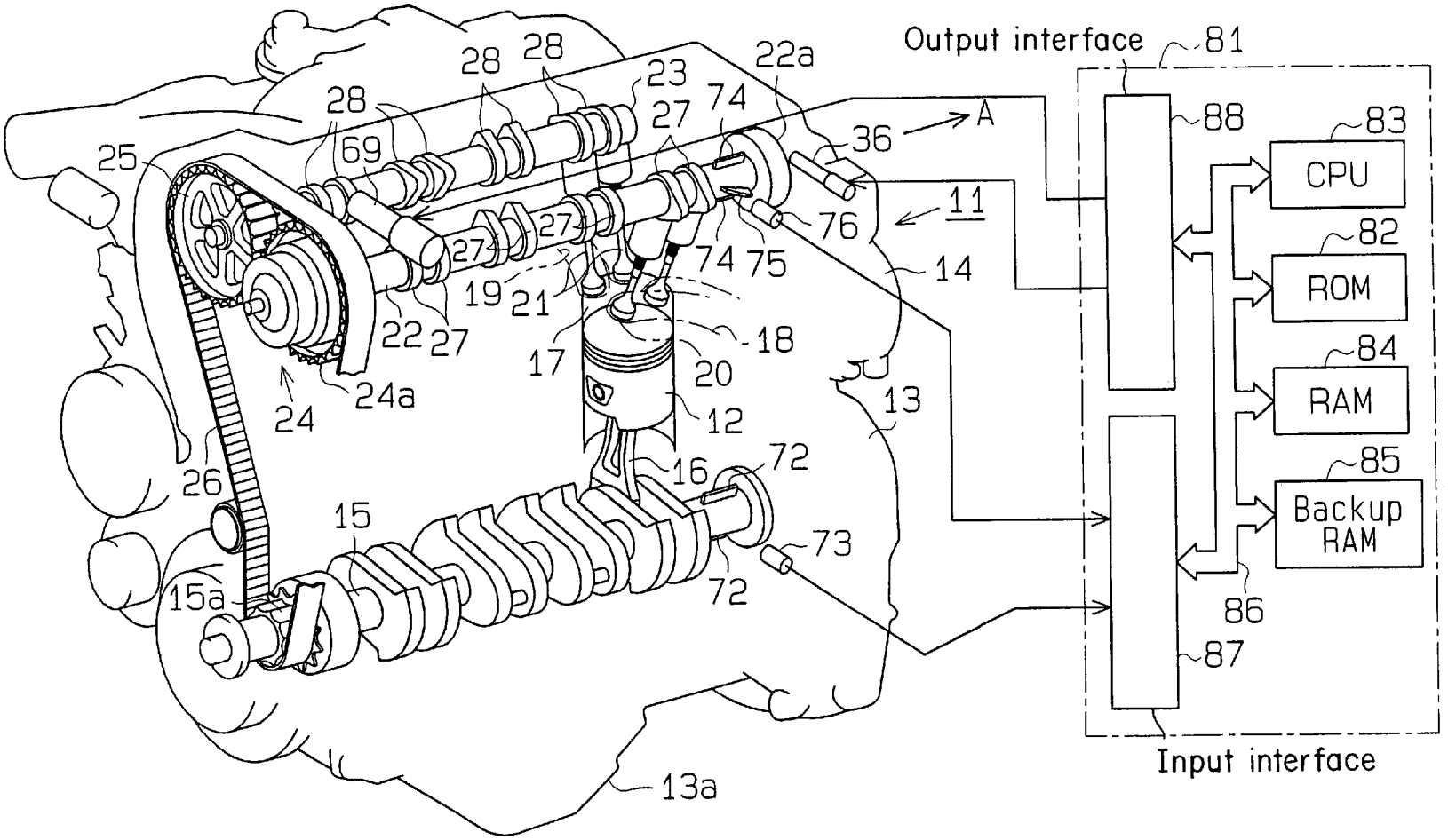
FIG. 1 is a partial perspective view illustrating a variable valve performance mechanism according to a first embodiment of the present invention.

As shown in FIG. 1, an engine 11 has a cylinder block 13, an oil pan 13*a*, which is located under the cylinder block 13, and a cylinder head 14, which is located on top of the cylinder block 13. A plurality of pistons 12 (only one is shown) are reciprocally accommodated in the cylinder block 13.

A crankshaft 15 is rotatably supported in the lower portion of the engine 11. Each piston 12 is connected to the crankshaft 15 by a connecting rod 16. Reciprocation of the pistons 12 is converted into rotation of the crankshaft 15 by the connecting rod 16. A combustion chamber 17 is defined above each piston 12. An intake passage 18 and an exhaust passage 19 are connected to the combustion chamber 17. An intake valve 20 selectively connects and disconnects the combustion chamber 17 with the intake passage 18. An exhaust valve 21 selectively connects and disconnects the combustion chamber 17 with the exhaust passage 19.

An intake camshaft 22 and an exhaust camshaft 23 are rotatably supported in the cylinder head 14 and extend parallel to each other. The intake camshaft 22 is axially movable. A pulley 24*a* and a variable valve timing mechanism 24 are located on one end of the intake camshaft 22. A camshaft moving mechanism 22*a* is located on the other end of the intake camshaft 22. The mechanism 22*a* moves the camshaft 22 axially. A pulley 25 is fixed to one end of the exhaust camshaft 23. The pulley 25 and the pulley 24*a* of the mechanism 24 are coupled to a pulley 15*a* fixed to the crankshaft 15 by a timing belt 26. Rotation of the crankshaft 15 is transmitted to the intake and exhaust camshafts 22, 23 by the timing belt 26.

A plurality of intake cams 27 are provided on the intake camshaft 22. The intake cams 27 contact the upper end of the intake valves 20. A plurality of exhaust cams 28 are fixed to the exhaust camshaft 23. The exhaust cams 28 contact the upper end of the exhaust valves 21. Rotation of the intake and exhaust camshafts 22, 23 causes the intake and exhaust cams 27, 28 to reciprocate the intake and exhaust valves 20, 21. Accordingly, the valves 20, 21 open and close the combustion chambers 17.

The profile of the exhaust cams 28 is constant along the axis of the exhaust camshaft 23. The profile of the intake cams 27, on the other hand, continuously changes along the axis of the intake camshaft 22. When the speed of the engine 11 is high, the intake camshaft 22 is moved in the direction of an arrow A. This gradually prolongs the opening duration of the intake cams 27 and gradually increases the lift of the valves 20. As a result, the intake efficiency of air-fuel mixture into the combustion chamber 17 is improved. When the speed of the engine 11 is low, the camshaft 22 is moved in a direction opposite the direction A. This gradually shortens the opening duration of the cams 27 and gradually decreases the lift of the valves 20. As a result, air-fuel mixture is quickly drawn into the combustion chamber 17. In this manner, the opening duration and the valve lift of the intake valves 20 is adjusted by moving the intake camshaft 22 along its axis in accordance with the engine speed.

The camshaft moving mechanism 22*a* and an oil supply mechanism, which hydraulically actuates the mechanism 22*a*, will now be described with reference to FIG. 2.

Figure 2:
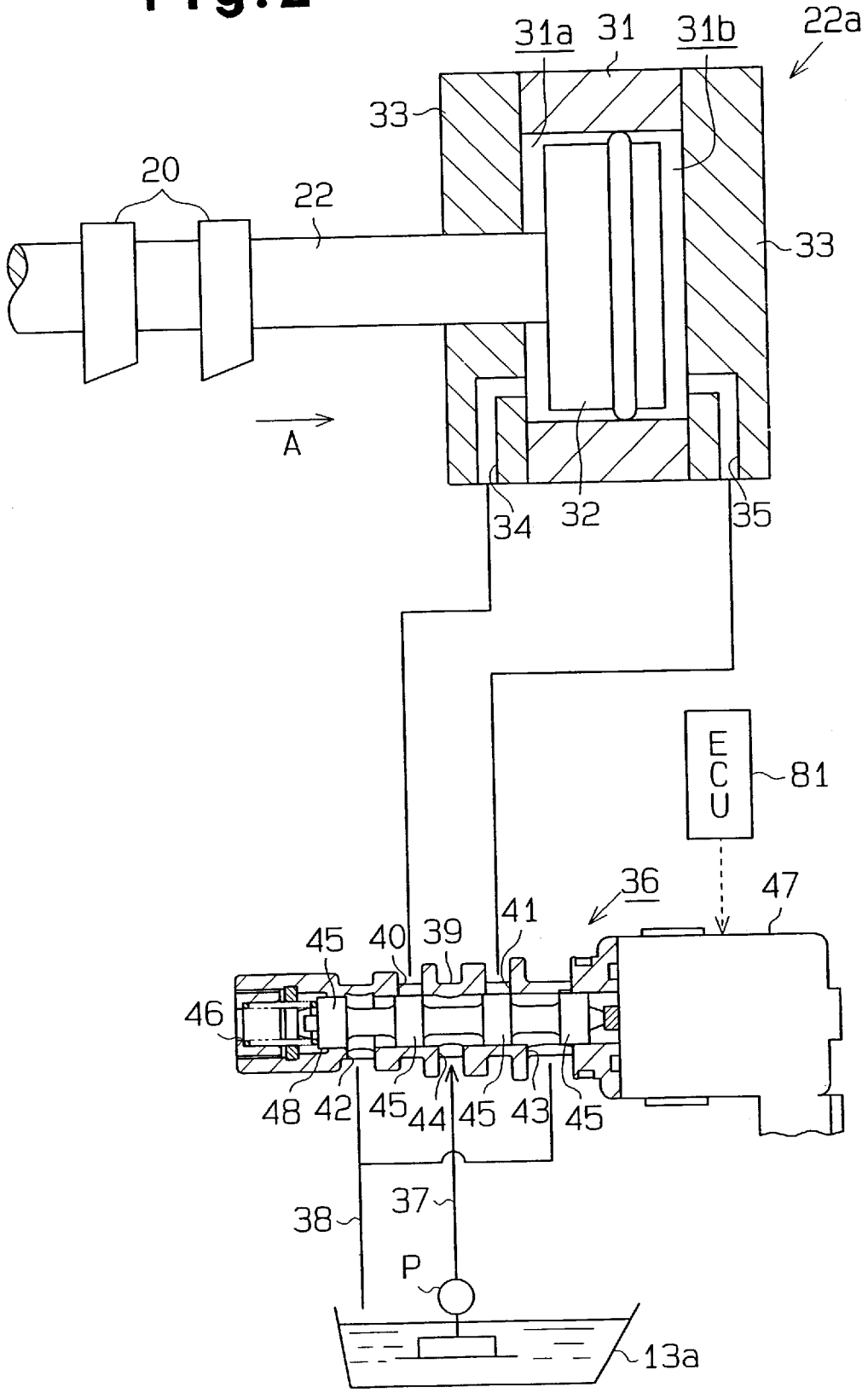
FIG. 2 is a diagrammatic cross-sectional view illustrating a camshaft moving mechanism incorporated in the apparatus of FIG. 1.

As shown in FIG. 2, the mechanism 22*a* includes a cylinder tube 31 and a piston 32 accommodated in the cylinder tube 31. A pair of end covers 33 close the openings of the tube 31. The intake camshaft 22 extends through one of the covers 33 and is coupled to the piston 32. The piston 32 defines a first pressure chamber 31*a* and a second pressure chamber 31*b* in the tube 31. A first passage 34 and a second passage 35 are formed in the covers 33, respectively. The first passage 34 communicates with the first pressure chamber 31*a* and the second passage 35 communicates with the second pressure chamber 31*b*.

When oil is supplied to the first pressure chamber 31*a* or the second pressure chamber 31*b* via the first passage 34 or the second passage 35, respectively, the piston 32 is moved axially. Accordingly, the intake camshaft 22 is moved axially in a direction corresponding to the chamber 31*a*, 31*b* that is pressurized.

The first passage 34 and the second passage 35 are connected to a first oil control valve (OCV) 36. A supply passage 37 and a drain passage 38 are connected to the first OCV 36. The supply passage 37 is connected to the oil pan 13*a* via an oil pump P, which is actuated by rotation of the crankshaft 15, whereas the drain passage 38 is directly connected to the oil pan 13*a*.

The first OCV 36 has a casing 39. The casing 39 has first and second supply and drain ports 40, 41, first and second drain ports 42, 43 and a supply port 44. The first and second supply and drain ports 40, 41 are connected to the first and second supply and drain passages 34, 35. The supply port 44 is connected to the supply passage 37 and the first and second drain ports 42, 43 are connected to the drain passage 38. The casing 39 accommodates a spool 48, which has four valve bodies 45. The spool 48 is urged in one direction by a coil spring 46 and in opposite direction by an electromagnetic solenoid 47.

When the solenoid 47 is de-excited, the force of the spring 46 pushes the spool 48 to an end of the casing 39 (right side as viewed in FIG. 2). This communicates the first supply and drain port 40 with the first drain port 42, and the second supply and drain port 41 with the supply port 44. In this state, oil in the oil pan 13*a* is supplied to the second pressure chamber 31*b* via the supply passage 37, the first OCV 36 and the second supply and drain passage 35. Also, oil in the first pressure chamber 31*a* is returned to the oil pan 13*a* via the first supply and drain passage 34, the first OCV 36 and the drain passage 38. As a result, the piston 32 and the intake camshaft 22 are moved in the direction opposite the direction A.

When the solenoid 47 is excited, the spool 48 is moved to the other end (left side as viewed in FIG. 2) against the force of the spring 46. This communicates the second supply and drain port 41 with the second drain port 43 and the first supply and drain port 40 with the supply port 44. In this state, oil in the oil pan 13*a* is supplied to the first pressure chamber 31*a* via the supply passage 37, the first OCV 36 and the first supply and drain passage 34. Oil in the second pressure chamber 31*b* is returned to the oil pan 13*a* via the second supply and drain passage 35, the first OCV 36 and the drain passage 38. As a result, the piston and the intake camshaft 22 are moved in the direction A.

Further, the spool 48 is positioned midway between the ends of the casing 39 by controlling current to the solenoid 47. In this state, the first and second supply and drain ports 40, 41 are closed and oil flow through the ports 40, 41 is stopped. Oil is therefore not supplied to or drained from the first and second pressure chambers 31*a*, 31*b*. Oil remaining in the chambers 31*a*, 31*b* fixes the position of the piston 32 and the intake camshaft 22.

The variable valve timing mechanism 24 will now be described with reference to FIG. 3.

Figure 3:
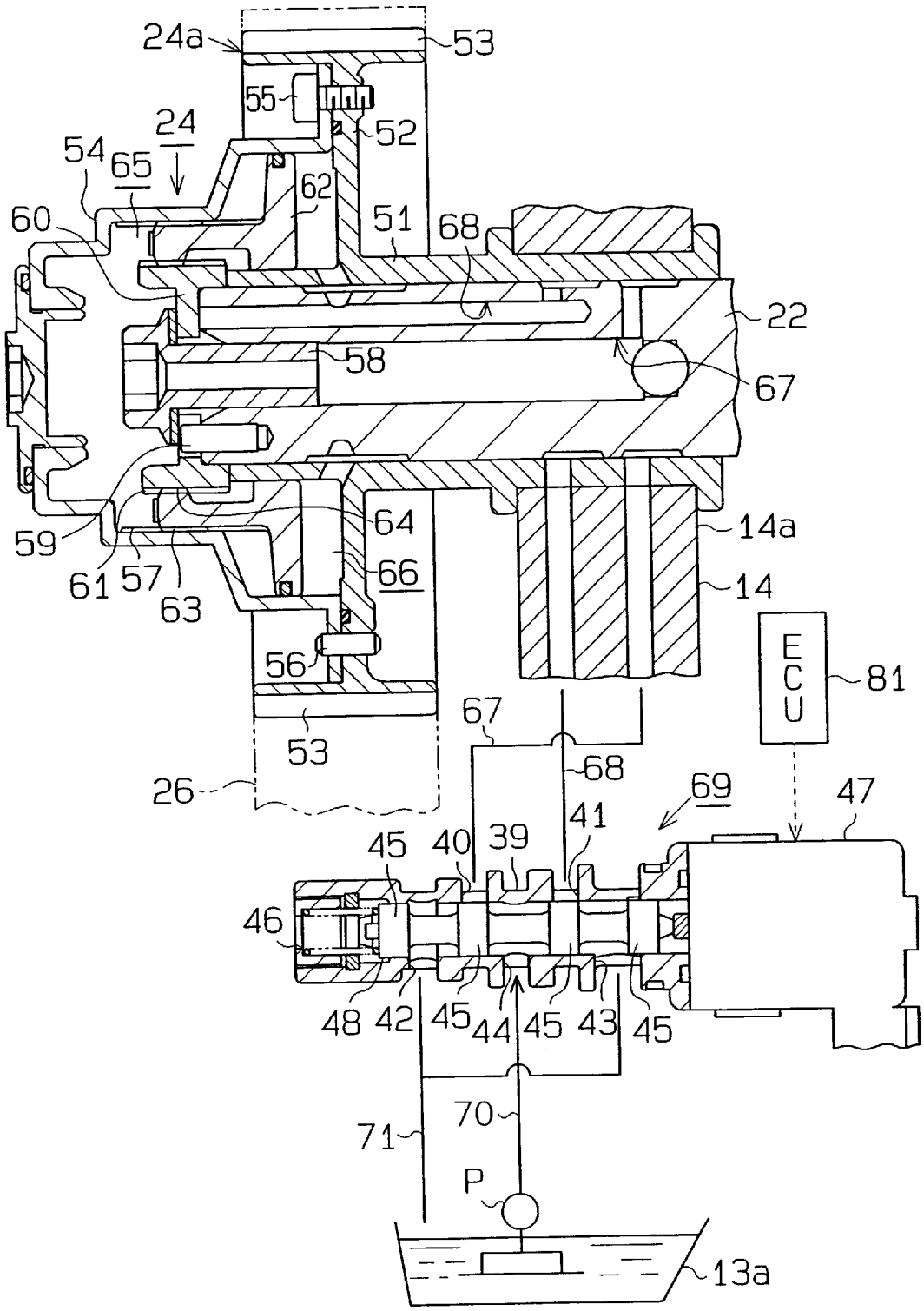
FIG. 3 is a diagrammatic cross-sectional view illustrating a variable valve timing mechanism of FIG. 1.

As shown in FIG. 3, the variable valve timing mechanism 24 includes the pulley 24*a*. The pulley 24*a* includes a boss 51, through which the camshaft 22 extends, a disk portion 52 extending radially from the boss 51 and a plurality of outer teeth 53 formed on the peripheral surface of the disk portion 52. The boss 51 is rotatably supported on the bearing 14*a* of the cylinder head 14. The intake camshaft 22 is movable axially within the boss 51. The timing belt 26 is engaged with the outer teeth 53.

A cover 54 is secured to the pulley 24*a* by a plurality of bolts 55 and pins 56 to cover the distal end of the intake camshaft 22. A plurality of inner teeth 57 are formed on the inner face of the cover 54. The inner teeth 57 constitute helical splines. An inner gear 60 is fastened to the distal end of the camshaft 22 by a hollow bolt 58 and a plurality of pins 59. A plurality of outer teeth 61 are formed on the inner gear 60 and extend along the axis of the camshaft 22. The outer teeth 61 and the inner teeth 57 face each other. A cylindrical ring gear 62 is located between the sets of teeth 61, 57 to slide along the axis of the intake camshaft 22. A plurality of outer teeth 63, which are helical splines, are formed on the outer face of the ring gear 62. The teeth 63 are engaged with the inner teeth 57 of the cover 54. A plurality of inner teeth 64 are formed on the inner face of the ring gear 62 and extend along the axis of the camshaft 22. The inner teeth 64 are engaged with the outer teeth 61 of the inner gear 60.

When the engine is running, rotation of the crankshaft 15 is transmitted to the pulley 24*a* by the timing belt 26. The pulley 24*a* integrally rotates the intake camshaft 22. As described above referring to FIG. 1, rotation of the intake camshaft 22 causes the intake valves 20 to open and close.

When the ring gear 62 is moved toward the pulley 24*a* (rightward as viewed in FIG. 3), the rotational phase of the camshaft 22 is changed relative to that of the pulley 24*a* by the outer teeth 63 of the ring gear 62. This retards the rotational phase of the camshaft 22 relative to the crankshaft 15 thereby retarding the valve timing of the intake valves 20. When the ring gear 62 is moved toward the cover 54 (leftward as viewed in FIG. 3), the rotational phase of the camshaft 22 is changed in the opposite direction relative to the pulley 24*a* by the outer teeth 63 of the ring gear 62. This advances the rotational phase of the cam shaft 22 relative to the crank shaft 15 thereby advancing the valve timing of the intake valves 20.

Generally, the valve timing of the intake valves 20 is retarded for stabilizing the running state of the engine 11. The valve timing of the valves 20 is advanced for improving the intake efficiency of intake of air-fuel mixture drawn into the combustion chambers 17 when the engine speed is high.

Hydraulic actuation of the ring gear 62 will now be described.

The ring gear 62 defines a phase retarding oil pressure chamber 65 and a phase advancing oil pressure chamber 66 in the cover 54. A phase retarding oil passage 67 and a phase advancing oil passage 68 are formed in the intake camshaft 22. The passages 67, 68 are connected to the chambers 65, 66, respectively. The phase retarding passage 67 is connected to the phase retarding chamber 65 by the hollow bolt 58 and extends through the cylinder head 14 to a second oil control valve (OCV) 69. The phase advancing passage 68 is connected to the phase advancing chamber 66 through the boss 51 of the pulley 24*a* and extends through the cylinder head 14 to the second OCV 69. A supply passage 70 and the drain passage 71 are connected to the second OCV 69. The supply passage 70 is connected to the oil pan 13*a* via the oil pump P, and the drain passage 71 is directly connected to the oil pan 13*a*. Therefore, the oil pump P supplies oil to the two supply passages 37 (see FIG. 2) and 70 from the oil pan 13*a*.

The second OCV 69 has the same construction as the first OCV 36 and includes a casing 39, first and second supply and drain passages 40, 41, first and second drain ports 42, 43, a supply port 44, a coil spring 46, an electromagnetic solenoid 47 and a spool 48. The first and second supply and drain ports 40, 41 are connected to the phase retarding passage 67 and the phase advancing passage 68, respectively. The supply passage 70 is connected to the supply port 44 and the drain passage 71 is connected to the first and second drain ports 42, 43.

When the solenoid 47 is de-excited, the force of the spring 46 pushes the spool 48 to an end of the casing 39 (right side as viewed in FIG. 3). This communicates the first supply and drain port 40 with the first drain port 42, and the second supply and drain port 41 with the supply port 44. In this state, oil in the oil pan 13*a* is supplied to the phase advancing chamber 66 of the mechanism 24 via the supply passage 70, the second OCV 69 and the phase advancing passage 68. At the same time, oil in the phase retarding chamber 65 is returned to the oil pan 13*a* via the phase retarding passage 67, the second OCV 69 and the drain passage 71. As a result, the ring gear 62 is moved toward the retarding chamber 65 and the valve timing of the intake valves 20 is advanced.

When the solenoid 47 is excited, the spool 48 is moved to the other end (left side as viewed in FIG. 3) against the force of the spring 46. This communicates the second supply and drain port 41 with the second drain port 43, and the first supply and drain port 40 with the supply port 44. In this state, oil in the oil pan 13*a* is supplied to the phase retarding chamber 65 of the mechanism 24 via the supply passage 70, the second OCV 69 and the phase retarding passage 67. At the same time, oil in the advancing chamber 66 is returned to the oil pan 13*a* via the phase advancing passage 68, the second OCV 69 and the drain passage 71. As a result, the ring gear 62 is moved toward the phase advancing chamber 66 and the valve timing of the intake valves 20 is retarded.

Further, the spool 48 is positioned midway between the ends of the casing 39 by controlling current to the solenoid 47. In this state, the first and second supply and drain ports 40, 41 are closed and oil flow through the ports 40, 41 is stopped. Oil is therefore not supplied to or drained from the phase retarding and phase advancing chambers 65, 66. Oil remaining in the chambers 65, 66 fixes the position of the ring gear 62 and the valve timing of the intake valves 20 is fixed, accordingly.

Detection of the axial position of the intake camshaft 27 and changes in the rotational phase of the camshaft 22 relative to the crankshaft 15 will now be described.

As shown in FIG. 1, a pair of detection blades 72 are fixed to the crankshaft 15 near the end opposite the pulley 15*a*. The blades 72 are made of magnetic material. An electromagnetic pickup 73 is located to face the blades 72. Similarly, a first detection blade 75 and a pair of second detection blades 74 are fixed to the intake camshaft 22 near the end opposite the mechanism 24. The blades 75, 74 are also made of magnetic material. An electromagnetic pickup 76 is located facing the blades 75, 74.

Figure 4A:
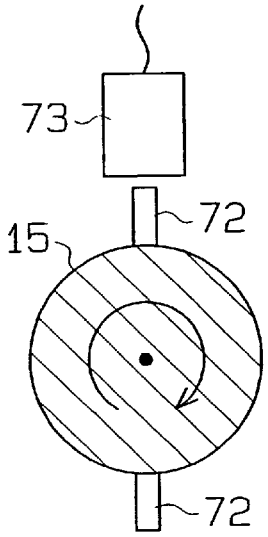
FIG. 4(*a*) a front cross-sectional view illustrating an electromagnetic pickup and detection blades on a crankshaft.
Figure 4B:
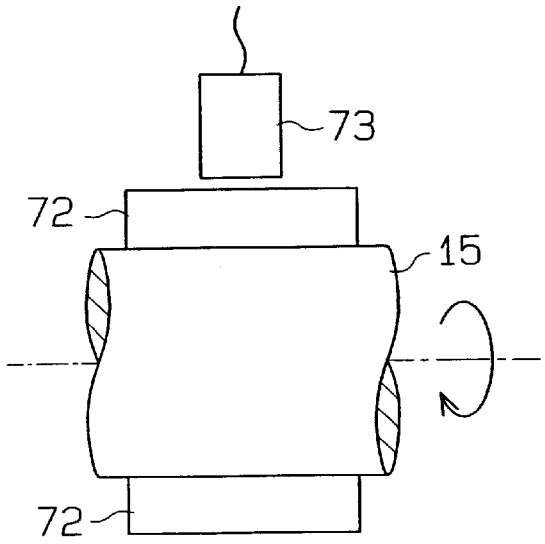

As shown in FIGS. 4(*a*) and 4(*b*), the detection blades 72 on the crankshaft 15 extend in a plane that includes the axis of the crankshaft 15, and they angularly are spaced apart by 180 degrees. When the crankshaft 15 rotates, the blades 72 pass by the pickup 73 in the rotating direction of the crankshaft 15. The passing of each blade 72 by the pickup 73 produces current in the pickup 73. The pickup 73 outputs the produced current as a pulse.

Figure 5A:
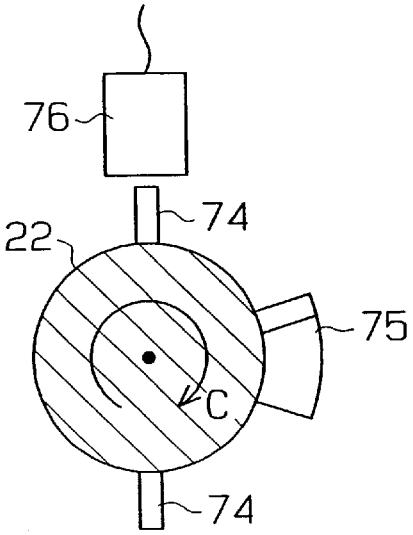
FIG. 5(*a*) a front cross-sectional view illustrating an electromagnetic pickup and first and second detection blades on a camshaft.
Figure 5B:
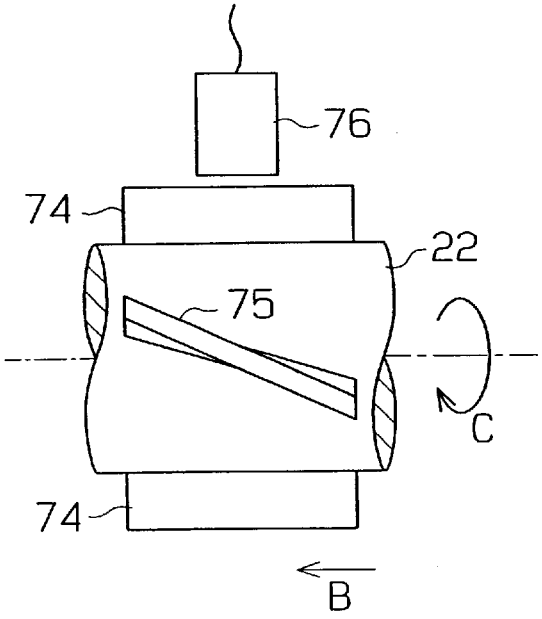
Figure 6:
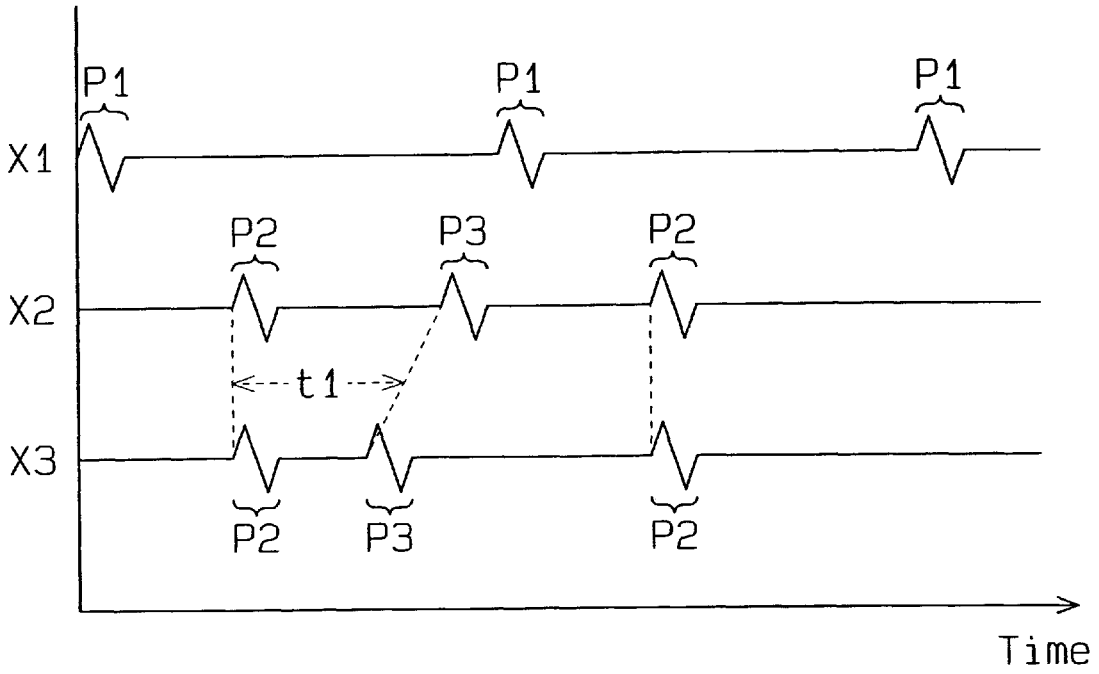
FIG. 6 is a graph showing the waveforms of pulses output from the pickups of FIG. 4(*a*) and FIG. 5(*a*)

As shown in FIGS. 5(*a*) and 5(*b*), the second blades 74 on the intake camshaft 22 extend in a plane including the axis of the camshaft 22, and they are angularly spaced apart by 180 degrees. The first blade 75 is located on the camshaft 22 between the second blades 74. The first blade 75 extends helically on the camshaft 22 relative to the axis of the camshaft 22. When the camshaft 22 rotates, the second blades 74 and the first blade 75 pass by the pickup 76 in the rotating direction of the camshaft 22. The passing of one of the blades 75, 74 by the pickup 76 produces current in the pickup 76. The pickup 76 outputs the produced current as a pulse.

The electrical construction of the variable valve performance apparatus according to this embodiment will now be described with reference to FIG. 1.

The first and second OCVs 36, 69 are controlled by an electronic control unit (ECU) 81. The ECU 81 is a logical computing circuit including a read-only memory (ROM) 82, a central processing unit (CPU) 83, a random access memory (RAM) 83 and a backup RAM 85.

The ROM 82 stores various control programs and maps used in the programs. The CPU 83 executes various computations in accordance with the programs. The RAM 84 temporarily stores the result of the computations by the CPU 83 and data from various sensors. The backup RAM 85 is a non-volatile storage that stores necessary data when the engine 11 is stopped. The ROM 82, the CPU 83, the RAM 84, the backup RAM 85, an external input circuit 87 and external output circuit 88 are connected to one another by a bus 86.

Connected to the external input circuit 87 are various sensors for detecting the running state of the engine 11 such as a rotational speed sensor, an intake pressure sensor and a throttle sensor. The electromagnetic pickups 73, 76 are also connected to the external input circuit 87. The first and second OCVs 36, 69 are connected to the external output circuit 88.

The ECU 81 controls the performance of the intake valves 20. That is, the ECU 81 controls the second OCV 69 based on detection signals input from the various sensors that detect the running state of the engine 11. Accordingly, the OCV 69 actuates the mechanism 24 such that the valve timing of the intake valves 20 is suitable for the running state of the engine 11. The ECU 81 also controls the first OCV 36 based on detection signals from the various sensors. Accordingly, the OCV 36 actuates the moving mechanism 22*a* such that the opening duration and the valve lift of the intake valves 20 are suitable for the running state of the engine 11.

The ECU 81 receives pulses from the pickups 73, 76. When the crankshaft 15 is rotating, the pickup 73 outputs pulses P1 in a waveform X1 of FIGS. 6 and 7. The pulses P1 correspond to the detection of blades 72, and there is a constant time interval between each pair of pulses P1 in the graphs of FIGS. 6 and 7. When the intake camshaft 22 is rotating, the pickup 76 outputs pulses P2, P3 in a waveform X2 of FIGS. 6 and 7. The pulses P2 correspond to the second detection blades 74 and the pulse P3 corresponds to the first detection blade 75.

When the pickup 76 is outputting the pulses P2, P3 of the waveform X2, if the intake camshaft 22 is moved in the direction of an arrow B in FIG. 5(*b*) by the mechanism 22*a*, the pickup 76 outputs pulses P2, P3 shown in a waveform X3. At this time, the rotational phase of the intake camshaft 22 relative to the crankshaft 15 is not changed. The change of the waveform from X2 to X3 only changes the timing of the pulse P3 and not the timing of the pulses P2.

The ECU 81 detects the position, or the amount of axial movement, of the camshaft 22 based on the change in the time period t1 from a referential pulse P2 to a subsequent pulse P3. The position detection of the intake camshaft 22 detected in this manner is more accurate than the camshaft position detection by the prior art gap sensor method. The ECU 81 then feedback controls the first OCV 36 based on the detected position of the camshaft 22 to move the camshaft 22 to a position that accurately corresponds to a desired cam profile.

Figure 7:
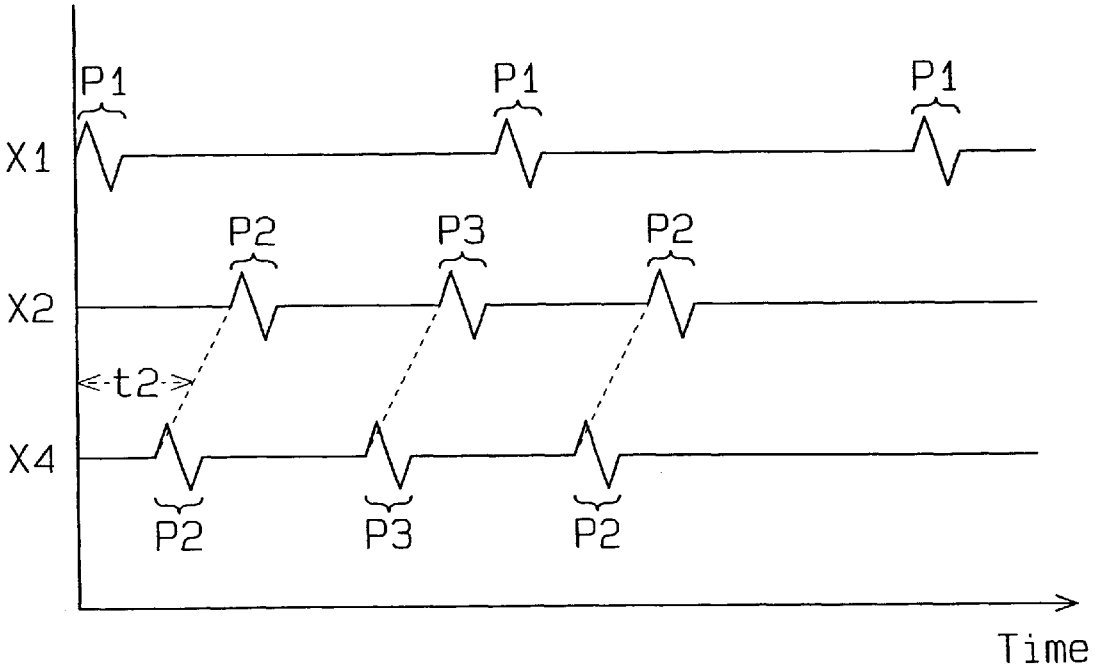
FIG. 7 is another graph showing the waveforms of pulse output from the pickups of FIG. 4(*a*) and FIG. 5(*a*)

When the pickup 76 is outputting the pulses P2, P3 of the waveform X2, if the rotational phase of the camshaft 22 relative to the crankshaft 15 is advanced (in a direction of an arrow C in FIGS. 5(*a*) and 5(*b*)) by the mechanism 24, the pickup 76 outputs pulses P2, P3 shown in a waveform X4 of FIG. 7. At this time, the axial position of the camshaft 22 is not changed. The change of the waveform from X2 to X4 uniformly shifts all the pulses P2 and P3.

The ECU 81 detects the rotational phase of the intake camshaft 22 relative to the crankshaft 15 based on the change in the time period t2 from a referential pulse P1 to a subsequent pulse P2. The ECU 81 then feedback controls the first OCV 69 based on the detected change in the rotational phase of the camshaft 22 thereby accurately changing the rotational phase of the intake camshaft 22.

The axial position of the camshaft 22 may be changed by the mechanism 22*a* when the rotational phase of the camshaft 22 is being changed by the mechanism 24. Even during such a change, the ECU 81 accurately controls the axial position and the rotational phase of the camshaft 22.

The embodiment of FIGS. 1–7 has the following advantages.

When the intake cams 27 and the intake camshaft 22 are moved axially, the time at which the pickup 76 outputs the pulse P3 upon detection of the first blade 75 is changed. The position of the intake cams 27 and the intake camshaft 22 is detected based on the changes in the time of the pulse P3, that is, on the change in the time period t1 between a reference pulse P2, which the pickup 76 produces when detecting one of the detection blades 74, and the pulse P3. Therefore, the position of the intake cams 27 and the intake camshaft 22 is more accurately detected compared to the prior art, in which the position of the intake camshaft is directly detected by a gap sensor. The highly accurate data of the cam position is used for feedback controlling the position of the camshaft 22. This allows the optimum cam profile suitable for the running state of the engine 11 to be selected.

When the rotational phase of the intake camshaft 22 relative to the crankshaft 15 is changed, the times at which the pickup 76 outputs pulses P2 upon detection of the second blades 74 are changed. The amount of the change in the rotational phase of the intake camshaft 22 relative to the crankshaft 15 is accurately detected based on the changes in the times of the pulses P2, that is, based on the changes in the time period t2 between a referential pulse P1, which the pickup 73 produces when detecting the blade 72 on the crankshaft 15, and the pulse P2. The highly accurate data of the rotational phase of the camshaft 22 is used for feedback controlling the rotational phase of the camshaft 22. This allows the optimum valve timing suitable for the running state of the engine 11 to be selected.

In the prior art apparatus, the axial position of the intake camshaft is directly detected by a gap sensor. However, in this embodiment, the position of the camshaft 22 is detected by simply detecting the first and second detection blades 75, 74 located on one end of the intake camshaft 22 by the electromagnetic pickup 76. Compared to a gap sensor, the detection blades 75, 74 and the pickup 76 are easily arranged in the engine 11.

A second embodiment of the present invention will now be described with reference to FIGS. 8 to 11. In this embodiment, a variable valve timing mechanism 91 is used instead of the variable valve timing mechanism 24. The mechanism 91 adjusts both the axial position and the rotational phase of the intake camshaft 22. The differences from the first embodiment will mainly be discussed below, and like or the same reference numerals are given to those components that are like or the same as the corresponding components of the first embodiment.

Figure 8:
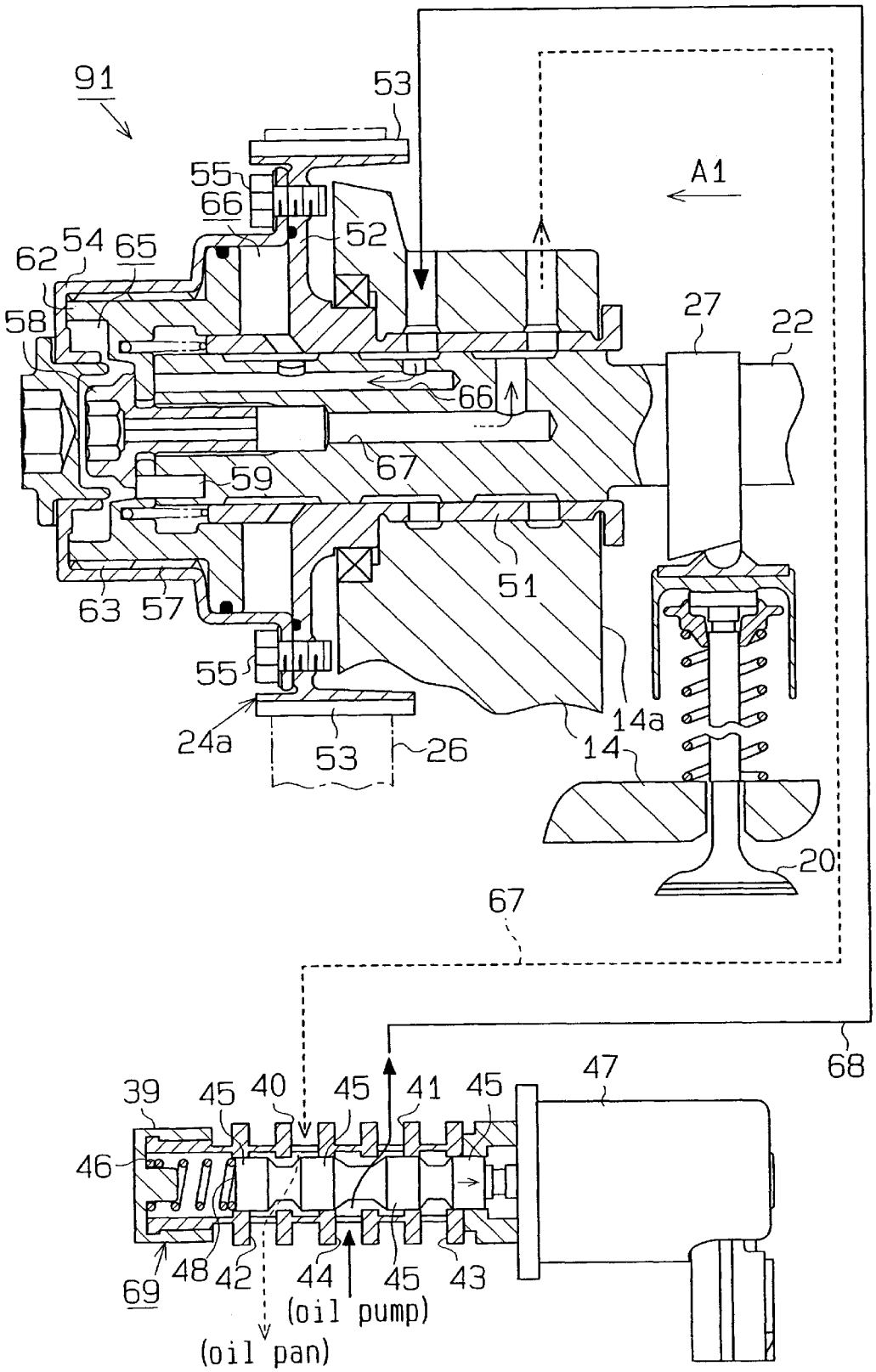
FIG. 8 is a diagrammatic cross-sectional view illustrating a variable valve performance apparatus according to a second embodiment of the present invention.

As shown in FIG. 8, the variable valve timing mechanism 91 includes a ring gear 62, which is directly fixed to the intake camshaft 22 by a hollow bolt 58 and a plurality of pins 59.

Supplying oil to a phase retarding oil pressure chamber 65 or to a phase advancing oil pressure chamber 66 causes the ring gear 62 and the intake camshaft 22 to integrally slide in a corresponding axial direction. At this time, cooperation of helical outer teeth 63 formed on the ring gear 62 and helical inner teeth 57 formed on the cover 54 changes the rotational phase of the intake camshaft 22 with respect to the crankshaft 15 (see FIG. 1). As a result, the intake camshaft 22 is axially moved while rotating with respect to the pulley 57. The intake cams 27 are thus moved axially while they rotate with respect to the pulley 57.

Figure 9:
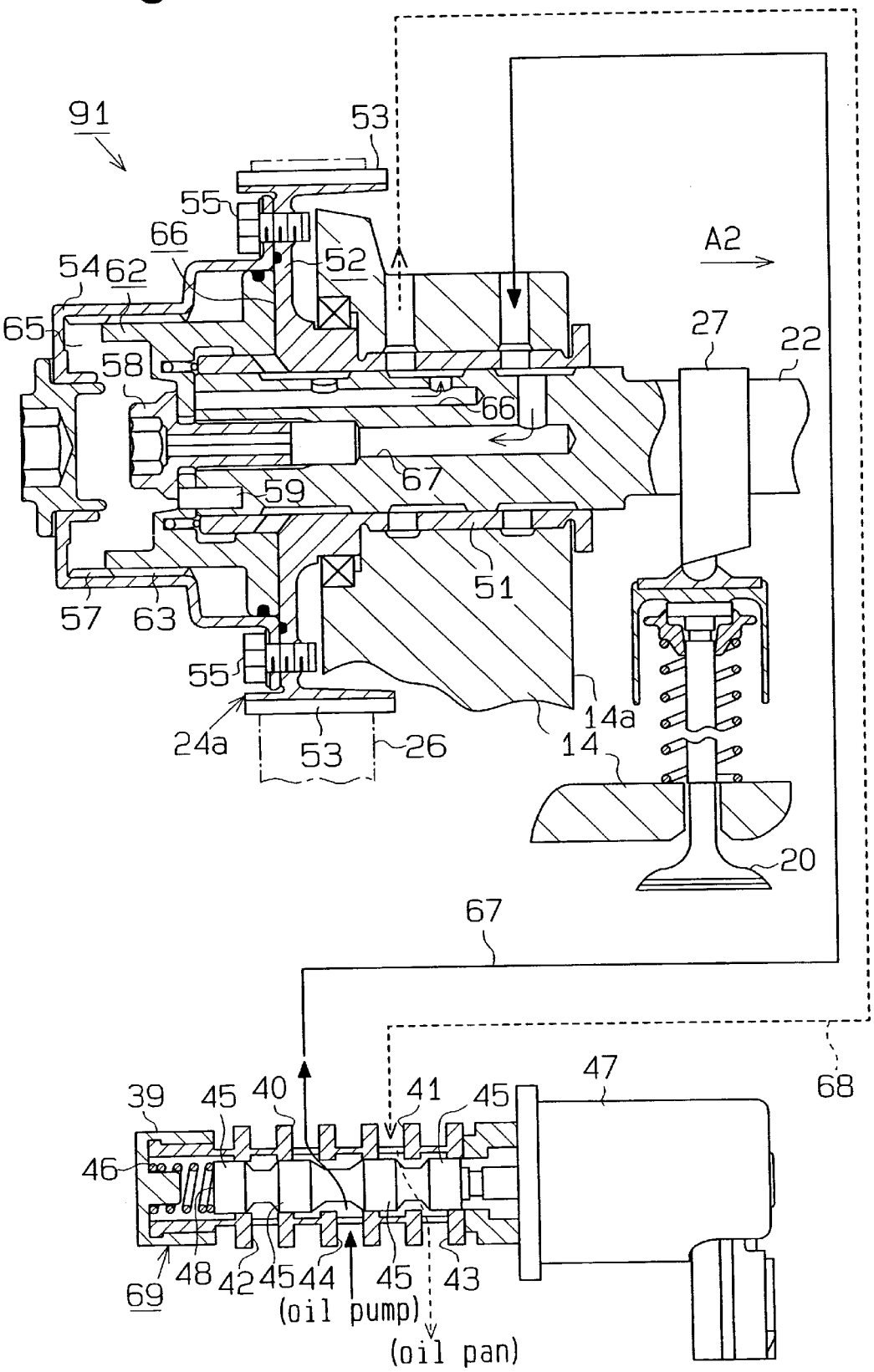
FIG. 9 is a diagrammatic cross-sectional view illustrating the apparatus of FIG. 8 in a different state.

When the solenoid 47 in the second OCV 69 is de-excited, oil is supplied to the phase advancing chamber 66 and oil in the phase retarding chamber 65 is drained. This moves the intake camshaft 22 and the intake cams 27 in the direction of an arrow A1 as illustrated in FIG. 8. The valve timing of the intake valves 20 is advanced, the opening duration of the valves 20 is shortened and the valve lift of the valves 20 is decreased. When the solenoid 47 of the OCV 69 is excited, oil is supplied to the phase retarding chamber 65 and oil in the phase advancing chamber 66 is drained. This moves the intake camshaft 22 and the intake cams 27 in the direction of an arrow A2 as illustrated in FIG. 9. The valve timing of the intake valves 20 is retarded, the opening duration of the valve 20 is prolonged and the valve lift of the valves 20 is increased.

Figure 10A:
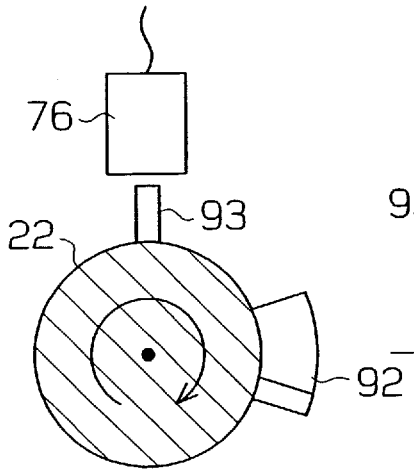
FIG. 10(*a*) is a front cross-sectional view illustrating an electromagnetic pickup and first and second detection blades.
Figure 10B:
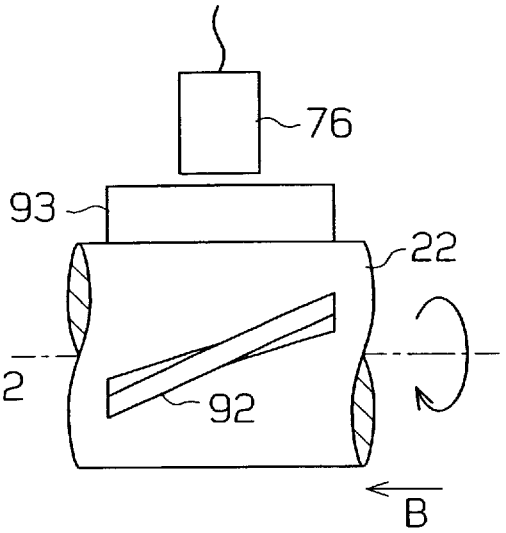

As shown in FIGS. 10(*a*) and 10(*b*), a first detection blade 93 and a second detection blade 92 are formed on the camshaft 22. The blades 93, 92 are made of magnetic material. Unlike the first embodiment, the crankshaft 15 has neither detection blades 72 nor an electromagnetic pickup 73. The second detection blade 92 extends about the camshaft 22 along a helix, which is a continuation of the helical path followed by a point on the cam 27 when the cam 27 moves axially. The first detection blade 93 extends in a plane that includes the axis of the camshaft 22.

Figure 11:
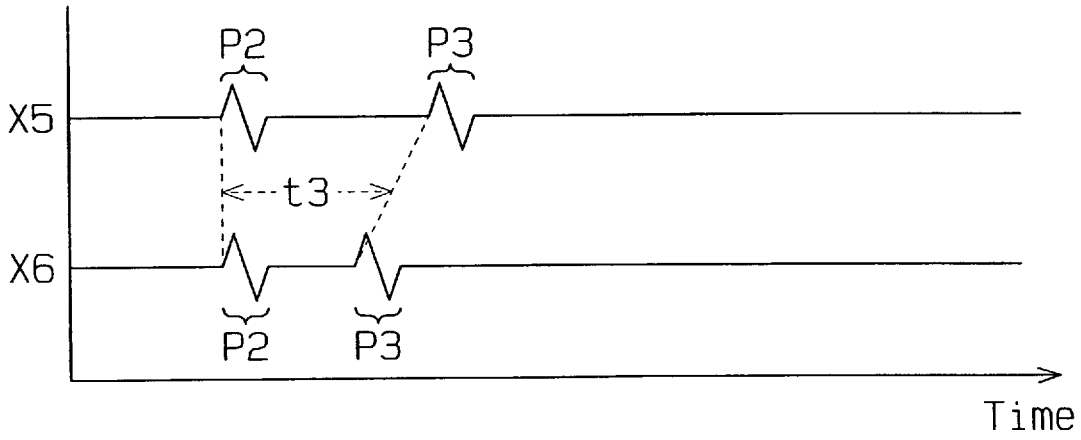
FIG. 11 is a graph showing waveforms of pulses output from the pickup of FIG. 10(*a*)

When the intake camshaft 22 is rotating, the electromagnetic pickup 76 outputs pulses P2 and P3 of a waveform X5 in FIG. 11. The pulses P3 and P2 correspond to the first and second detection blades 93 and 92, respectively.

When the pickup 76 is outputting the pulses P2, P3 of the waveform X5, if the intake camshaft 22 is moved in the direction of an arrow B in FIG. 10(*b*) by the mechanism 91, the pickup 76 outputs pulses P2, P3 shown in a waveform X6. At this time, the time of the pulse P3 is changed, whereas the time of the pulse P2 remains unchanged. This is because the second detection blade 92 extends along a helical path, which is a continuation of the helical path that a point on the intake cam 27 follows when the intake camshaft 22 is moved along its axis. In other words, the helix of the blade 92 matches that of the gear teeth 63, 57.

The ECU 81 detects the position of the camshaft 22 based on the change in the time period t3 from a referential pulse P2 to the subsequent pulse P3. As the camshaft 22 moves along its axis, the rotational phase of the camshaft 22 relative to the crankshaft 15 is changed. The ECU 81 therefore detects the rotational phase of the crankshaft 22 based on the axial position of the camshaft 22. As in the first embodiment, the detected axial position and rotational phase of the intake camshaft 22 are very accurate.

The ECU 81 then feedback controls the second OCV 69 based on the detected position and rotational phase of the camshaft 22 thereby moving the camshaft 22 to an axial position corresponding to a desired cam profile. This also changes the rotational phase of the camshaft 22 to a phase corresponding to a desired valve timing.

As described above, the axial position and the rotational phase of the intake camshaft 22 are accurately detected based on the detection of the second blade 92 and the first blade 93 by the pickup 76. Therefore, the second embodiment has the same advantages as the first embodiment.

In the embodiment of FIGS. 8–11, axial movement and change of the rotational phase of the intake camshaft 22 are simultaneously performed. The second detection blade 92 extends in a helical manner along a helix matching that of the helical gear teeth 63, 57. Therefore, when the intake camshaft 22 is moved axially while being rotated with respect to the pulley 53, the time at which the pickup 76 detects the second blade 92 is not changed and thus the timing of the pulse P2 is not changed. The axial position and rotational phase of the camshaft 22 is thus computed based on the time of pulse P3 in relation to the time of pulse P2. This eliminates the necessity for the detection blades 72 on the crankshaft 15 and the corresponding pickup 73.

A third embodiment of the present invention will now be described with reference to FIGS. 12 to 14. In this embodiment, the apparatus for detecting the axial position of the intake cams 27 is different from that of the second embodiment. Therefore, the differences from the second embodiment will mainly be discussed below, and like or the same reference numerals are given to those components that are like or the same as the corresponding components of the second embodiment.

Figure 12A:
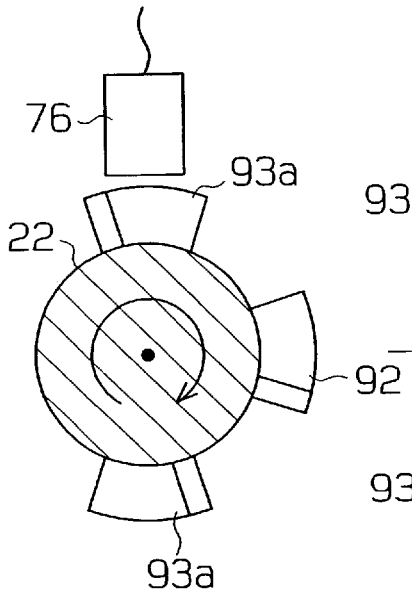
FIG. 12(*a*) front cross-sectional view illustrating an electromagnetic pickup and first and second detection blades according to a third embodiment of the present invention.
Figure 12B:
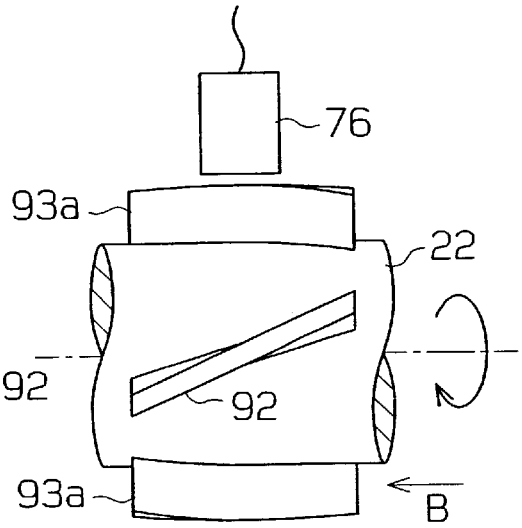

As shown in FIGS. 12(*a*) and 12(*b*), a pair of first detection blades 93*a* are provided on the intake camshaft 22 instead of the first detection blades 93 of the second embodiment. The first detection blades 93*a* are made of magnetic material. The blades 93*a* are spaced apart by 180 degrees about the axis of the camshaft 22. A second detection blade 92 is placed midway between the first blades 93*a*. The second blade 92 is also made of magnetic material. As in the second embodiment, the second blade 92 extends in a helical manner along the path of the intake cam 27.

The first detection blades 93*a* and the second detection blades 92 are twisted by equal but opposite helix angles. That is, the first blades 93*a* and the second blade 92 are symmetric with respect to a plane passing between them and through the axis of the intake camshaft 22.

When the camshaft 22 is rotated, the detection blades 92, 93*a* pass by the pickup 76. Specifically, only parts of the blades 92, 93*a* that are diagonally shaded in FIGS. 14(*a*) and 14(*b*) pass by the pickup 76. These parts will hereafter be referred to as detected portions 94.

The lengths H of the detected portions 94 as measured along the axis of the intake camshaft 22 (a direction perpendicular to an arrow D in FIG. 14) are equal to the width of the pickup 76. The widths Z of the detected portions 94 as measured along the circumferential direction of the camshaft 22 are equal to one another. This is because the helix angles of the second blade 92 and the first blades 93*a* are equal to each other even though the blades 92 and 93*a* have opposite helix angles.

Figure 13:
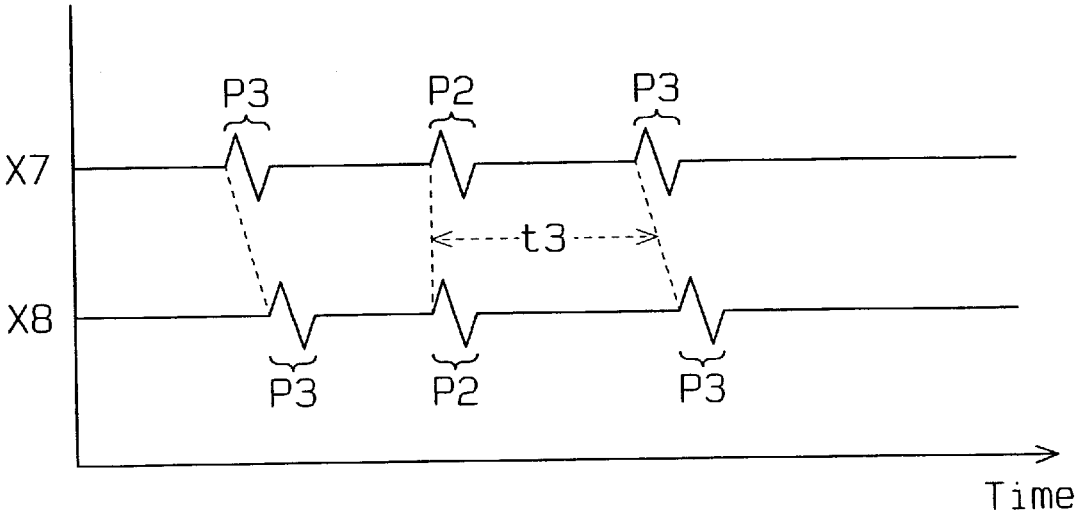
FIG. 13 is a graph showing waveforms of pulses output from the pickup of FIG. 12(*a*)
Figures 14A, 14B:
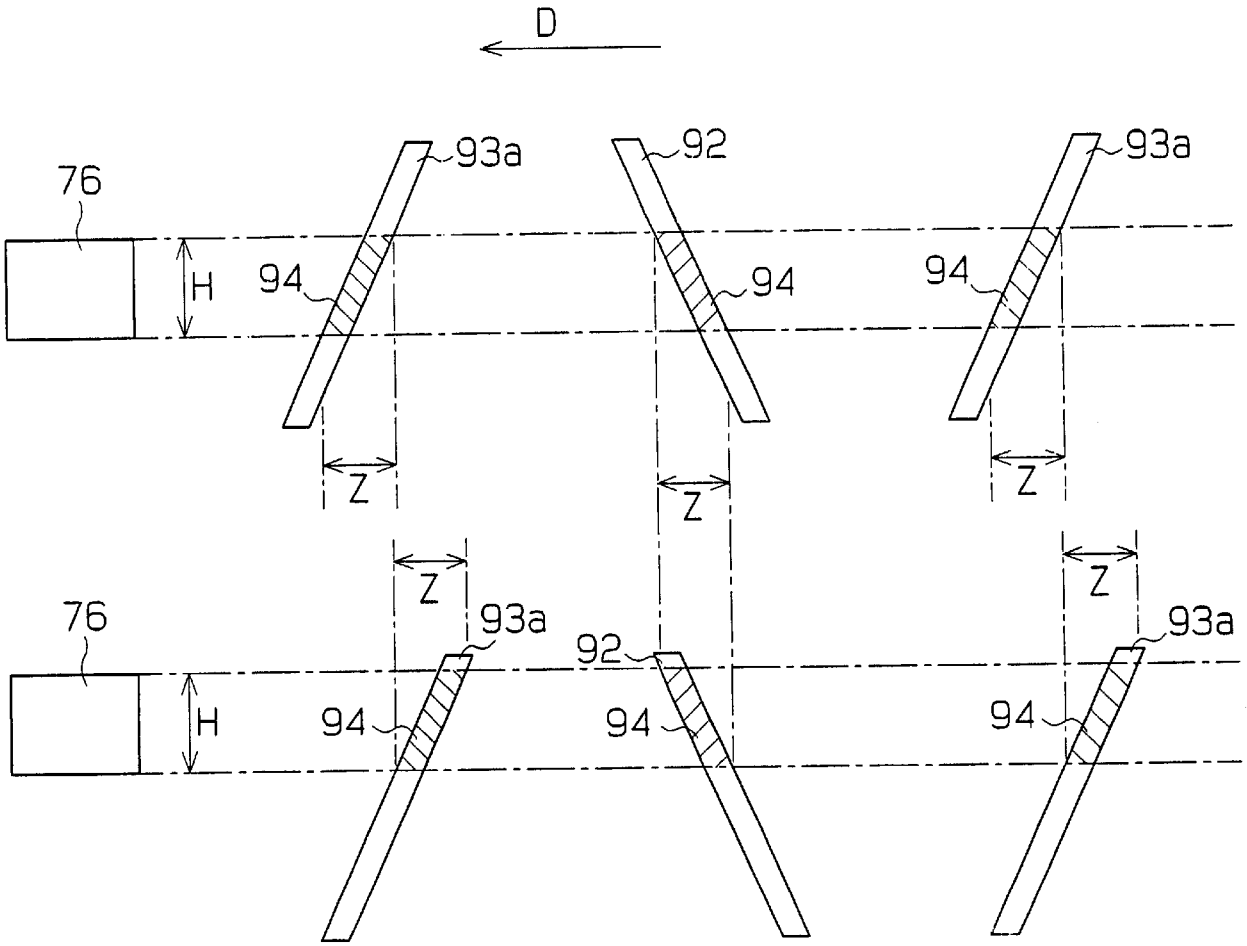
FIGS. 14(*a*) and 14(*b*) are diagrammatic views illustrating the relationship between the pickup and the detection blades of FIGS. 12(*a*) and 12(*b*)

When the detected portions 94 pass by the pickup 76, the pickup 76 outputs pulses P2 and P3 as in a waveform X7 in FIG. 13. The pulse P2 corresponds to the portion 94 of the second blade 92 and the pulses P3 correspond to the portions 94 of the first blades 93*a*. Since the widths Z of the portions 94 are equal, the widths of the pulses P2 and P3 are equal.

When the pickup 76 is outputting the pulses P2, P3 of the waveform X7, if the intake camshaft 22 is moved in the direction of an arrow B in FIG. 12(*b*) by the mechanism 91, the pickup 76 outputs pulses P2 and P3 shown in a waveform X8. That is, the positions of the detected portions 94 with respect to the pickup 76 change from the state of FIG. 14(*a*) to the state of FIG. 14(*b*). The waveform of the pulses P2 and P3 changes from X7 to X8. This does not change the time of the pulses P2 while changing the times of the pulses P3.

The ECU 81 detects the amount of axial movement of the camshaft 22 and the rotational phase of the camshaft 22 relative to the crankshaft 15 based on the change in the time period t3 from a referential pulse P2 to the subsequent pulse P3. Since the widths of the pulses P2 and P3 are equal to each other, the detected position and rotational phase of the intake camshaft 22 are more accurate relative to the second embodiment.

If the helix angle of the first detection blades 93*a* is different from that of the second detection blade 92, the lengths Z of the detected portions 94 on the first blades 93*a* are different from the length Z of the detected portion 94 on the second blade 92. The different lengths Z of the detected portions 94 causes the widths of the pulses P2 and P3 to be different from each other. This difference in the widths of the pulses P2 and P3 may cause an error in the detected position and rotational phase of the crankshaft 22, which are computed based on the time period t3 from the pulse P2 to the pulse P3.

However, although having different orientations, the second detection blade 92 and the first detection blades 93*a* have the same helix angle. Therefore, the lengths Z of the detected portions 94 on the blades 92, 93*a* are equal. As a result, the width of the pulse P2, which corresponds to the detected portion 94 on the second blade 92, is equal to the width of the pulse P3, which corresponds to the detected portion 94 on the first blades 93*a*. Thus, the changes in the axial position and rotational phase of the intake camshaft 22 are detected very accurately based on the time period t3.

The present invention may be embodied in the following forms.

In the first embodiment, the number of the second detection blades 74 may be changed. That is, the number of the second blades 74 may be one or more than two.

Figure 15A:
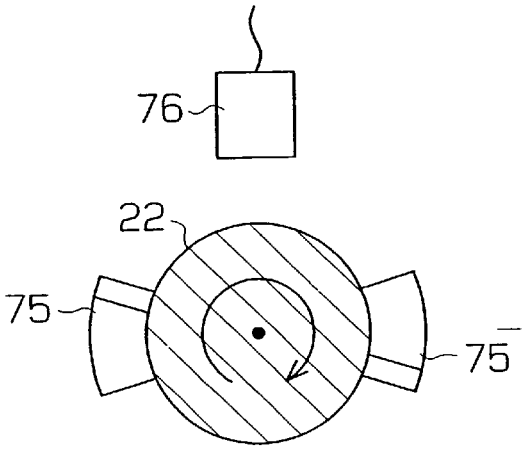
FIG. 15(*a*) is a front cross-sectional view illustrating another example of detection blades of the first embodiment.
Figure 15B:
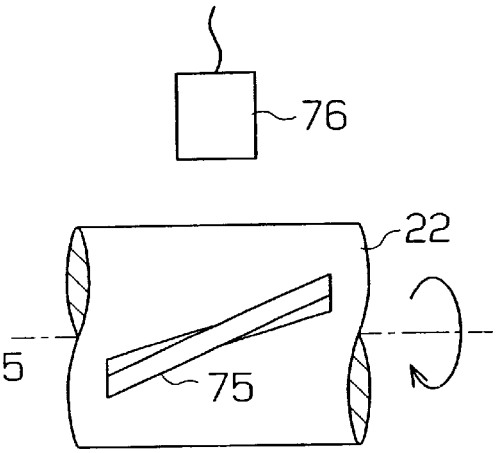

In the first embodiment, the second detection blades 74 may be omitted. In this case, the change in the timing of the pulse P3 is computed based on the time period between the pulse P1 and the pulse P3. This construction allows the number of the first detection blades 75 to be two as shown in FIGS. 15(*a*) and 15(*b*) or more than two.

In the first embodiment, the detection blades 72 and the electromagnetic pickup 73 may be omitted. Even in this case, the change in the timing of the pulse P3 is computed based on the time period t1 between the pulse P2 and the pulse P3. The time period t1 allows at least the axial position of the intake cams 27 on the intake camshaft 22 to be detected.

In the first embodiment, the cam profile of the intake cams 27 may be changed such that axial movement of the camshaft 22 changes the valve timing of the intake valves 20. In this case, the variable valve timing mechanism 24, which controls the rotational phase of the camshaft 22 relative to the crankshaft 15, is omitted.

In the second embodiment, the number of the second detection blades 92 may be more than one and the number of the first detection blades 93 may be more than one.

In the second embodiment, the second detection blade 92 may be omitted. In this case, a detection blade 72 and an electromagnetic pickup 73 as in the first embodiment are provided on the crankshaft 15 for producing referential pulses instead the pulse P2.

In the second embodiment, the first detection blades 93 do not necessarily extend linearly. For example, the first detection blade 93 may extend helically and off the helix of the gear teeth 63, 57.

In the third embodiment, the second detection blade 92 may be omitted. In this case, a detection blade that has the same shape as the second blade 92 and an electromagnetic pickup 73 as in the first embodiment are provided on the crankshaft 15 for producing a referential pulses instead the pulse P2. This construction has the same advantages as the third embodiment.

In the third embodiment, the number of the first detection blades 93*a* may be one or more than two. Also, the number of the second detection blade 92 may be more than one.

Figure 16A:
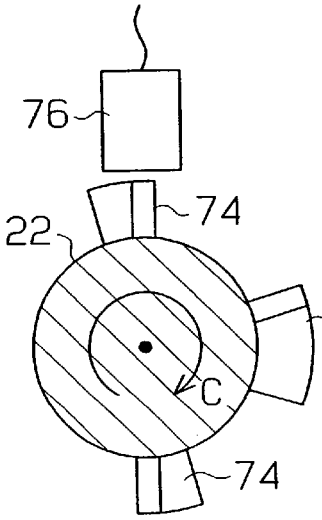
FIG. 16(*a*) is a front cross-sectional view illustrating yet another example of detection blades of the first embodiment.
Figure 16B:
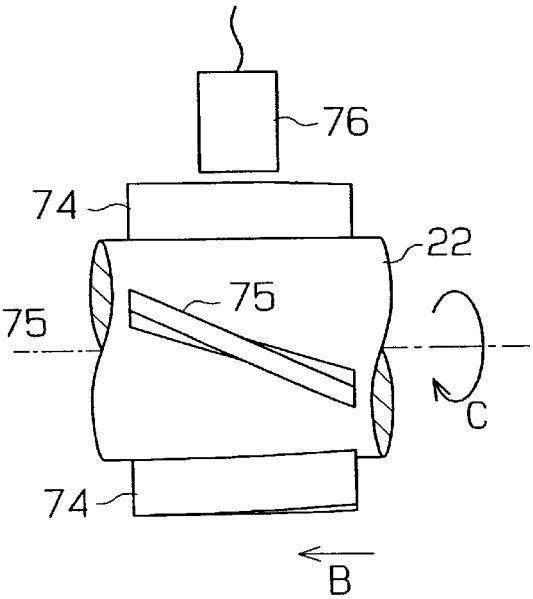
Figure 17:
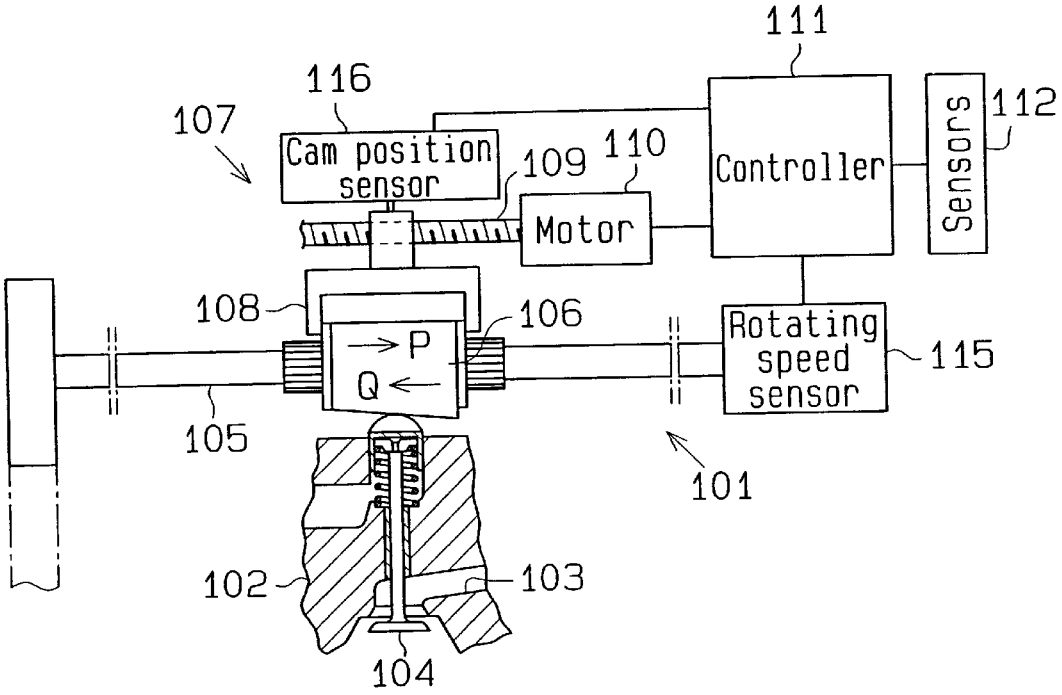
Fig.17 (Prior Art)
FIG. 17 is a schematic view illustrating a prior art variable valve performance apparatus.
Figure 18:
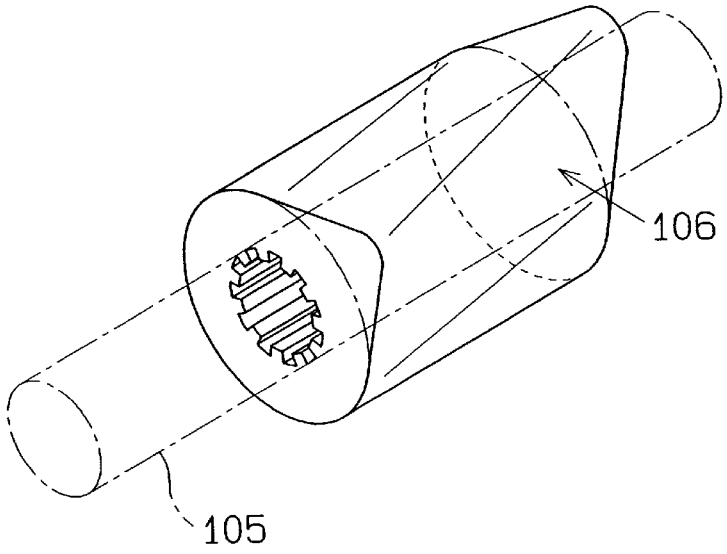
Fig.18 (Prior Art)
FIG. 18 is a perspective view showing the intake valve cam of the prior art apparatus of FIG. 17.

In the first embodiment, the second detection blade 74 may extend in a manner other than parallel to the axis of the camshaft 22. For example, the second detection blades 74 may extend helically in a different orientation from the first blade 75 as illustrated in FIGS. 16(*a*) and 16(*b*). Also, in the second and third embodiments, the second detection blade 92 may extend along a path that is different from the helix of the gear teeth. When the intake camshaft 22 is moved along its axis, the time periods t1, t3 from the pulse P2, which corresponds to the second detection blades 74, 92, to the pulse P3, which corresponds to the first detection blades 75, 93, 93*a*, are changed in accordance with the axial position of the camshaft 22. Therefore, the axial position of the intake camshaft 22 is detected based on the time periods t1, t3. Further, the relationship between the time periods t1, t3 and the axial position of the camshaft 22 may be previously learned.

In the first to third embodiments, the detection blades 72, 74, 75, 92, 93, 93*a* are provided on the shafts (the crankshaft 15 or intake camshaft 22) and the electromagnetic pickups 73, 76 are provided at positions off the shafts 15, 22. However, the positions of the blades and pickups are not limited. That is, the pickups 73, 76 may be located on the shafts 15, 22 and the detection blades 72, 74, 75, 92, 93, 93*a* may be located off the shafts.

In the first to third embodiments, the detection blades 72, 74, 75, 92, 93, 93*a* protrude radially from the shafts 15, 22. However, grooves may be formed on the shafts 15, 22 instead of forming the blades, or magnets may be embedded in the shafts 15, 22 instead of the blades.

In the first to third embodiment, the performance of the intake valve 20 is varied. However, the performance of the exhaust valve 21 may be varied. In this case, the exhaust cams 28 have the same profile as the intake cams 27 in the first to third embodiments. Further, the exhaust camshaft 23 is moved along its axis and the rotational phase of the camshaft 23 is altered.

Therefore, the present examples and embodiments are to be considered as illustrative and not restrictive and the invention is not to be limited to the details given herein, but may be modified within the scope and equivalence of the appended claims.

What is claimed is:

1. An apparatus for controlling valve performance in an engine, the engine including a valve for opening and closing a combustion chamber, wherein the valve is actuated with a variable valve performance including at least one of a variable valve lift amount and a variable valve timing, the apparatus comprising:

a camshaft;

a cam provided on the camshaft for integrally rotating with the camshaft to selectively open and close the valve, wherein the cam has a cam surface for slidably contacting the valve, the cam surface having a profile that varies axially;

an axial drive mechanism for moving the cam axially to change the valve performance, wherein the axial movement of the cam changes the axial position of a point on the cam surface with respect to the valve;

a detection element extending generally in the axial direction of the camshaft, wherein the detection element is arranged to extend along a path that is different from the path of movement followed by a point on the cam when the cam is moved by the axial drive mechanism;

a pulser for producing a pulse in response to the detection element passing by the pulser when the camshaft rotates;

a computer for computing the change of axial position of the cam produced by the axial drive mechanism based on a corresponding change of the time at which the pulser produces the pulse as measured from a reference time; and a controller for controlling the axial drive mechanism based on the axial position of the cam computed by the computer to move the cam to a desired axial position.

2. The apparatus according to claim 1, wherein the detection element is a first detection element and the pulse is a first pulse, and further comprising:

an output shaft provided in the engine for driving the camshaft;

a phase changing mechanism for changing the rotational phase position of the camshaft with respect to the output shaft;

a second detection element extending generally in the axial direction of the camshaft, wherein the second detection element is arranged to extend along a path that is similar to the path of movement followed by a point on the cam when the cam is moved by the axial drive mechanism;

wherein the pulser produces a second pulse in response to the second detection element passing by the pulser when the camshaft rotates; and wherein the computer computes the change of rotational phase position of the camshaft produced by the phase changing mechanism based on the change of the time at which the pulser produces the second pulse.

3. The apparatus according to claim 1, wherein one of the detection element and the pulser rotates and moves axially together with the cam.

4. The apparatus according to claim 3, wherein the cam is fixed to the camshaft, wherein the axial drive mechanism moves the cam together with the camshaft, wherein the detection element is located on the camshaft, and wherein the pulser faces the camshaft such that the detection element passes by the pulser when the camshaft rotates.

5. The apparatus according to claim 1 further comprising an output shaft provided in the engine for driving the camshaft, wherein the axial drive mechanism changes the rotational phase position of the camshaft with respect to the output shaft in response to the axial movement of the cam, and wherein the computer computes the rotational phase position of the camshaft based on the computed axial position of the cam.

6. The apparatus according to claim 5, wherein the detection element is a first detection element and the pulse is a first pulse, and further comprising a second detection element extending generally in the axial direction of the camshaft, wherein an angle of the second detection element with respect to the axis of the camshaft is different from the corresponding angle of the first detection element, and wherein the pulser produces a second pulse in response to the second detection element passing by the pulser when the camshaft rotates, and wherein the computer computes the axial position of the cam based on the time period between the time at which the pulser produces the second pulse and the time at which the pulser produces the first pulse.

7. The apparatus according to claim 6, wherein the second detection element is arranged to extend along a path that is similar to the path of movement followed by a point on the cam when the cam is moved by the axial drive mechanism, and wherein the computer computes the axial position of the cam based on the time period from the time at which the pulser produces the second pulse to the time at which the pulser produces the first pulse.

8. The apparatus according to claim 6, wherein the second detection element and the first detection element are symmetrical with respect to a plane passing through the axis of the camshaft.

9. The apparatus according to claim 6, wherein the cam is fixed to the camshaft, wherein the axial drive mechanism moves the cam together with the camshaft, wherein the second detection element is located on the camshaft, and wherein the pulser faces the camshaft such that the second detection element passes by the pulser when the camshaft rotates.

10. The apparatus according to claim 2 further comprising a standard pulsing device for producing an unchangeable standard pulse when the output shaft rotates, wherein the computer computes the axial position of the cam based on the time period from the time at which the pulser produces the second pulse to the time at which the pulser produces the first pulse, and the computer computes the rotational phase position of the camshaft based on the time period from the time at which the standard pulsing device produces the standard pulse to the time at which the pulser produces the second pulse.

11. An apparatus for controlling valve performance in an engine, the engine including a valve for opening and closing a combustion chamber, wherein the valve is actuated with a variable valve performance including a variable valve lift amount and a variable valve timing, the apparatus comprising:

a camshaft;

an output shaft provided in the engine for driving the camshaft;

a cam fixed to the camshaft to selectively open and close the valve, wherein the cam has a cam surface for slidably contacting the valve, the cam surface having a profile that varies axially;

an axial drive mechanism for moving the camshaft axially to change the valve lift amount, wherein the axial movement of the camshaft changes the axial position of a point on the cam surface with respect to the valve;

a phase changing mechanism for changing the rotational phase position of the camshaft with respect to the output shaft to change the valve timing;

a first detection element helically extending about the axis of the camshaft;

a second detection element located on the camshaft and extending in a direction parallel to the axis of the camshaft;

a pulser arranged to face the camshaft, wherein the pulser produces a first pulse and a second pulse in response to the first detection element and the second detection element passing by the pulser, respectively, when the camshaft rotates;

a standard pulsing device for producing an unchangeable standard pulse when the output shaft rotates;

a computer for computing the axial position of the camshaft based on the time period from the time at which the pulse produces the second pulse to the time at which the pulser produces the first pulse and computing the rotational phase rotation of the camshaft based on the time period from the time at which the standard pulsing device produces the standard pulse to the time at which the pulser produces the second pulse; and a controller for controlling the axial drive mechanism based on the axial position of the camshaft computed by the computer to move the camshaft to a desired axial position and for controlling the phase changing mechanism based on the rotational phase position of the camshaft computed by the computer to move the camshaft to a desired rotational phase position.

12. An apparatus for controlling valve performance in an engine, the engine including a valve for opening and closing a combustion chamber, wherein the valve is actuated with a variable valve performance including a variable valve lift amount and a variable valve timing, the apparatus comprising:

a camshaft;

an output shaft provided in the engine for driving the camshaft;

a cam fixed to the camshaft to selectively open and close the valve, wherein the cam has a cam surface for slidably contacting the valve, the cam surface having a profile that varies axially;

an axial drive mechanism for moving the camshaft axially to change the valve performance, wherein the axial movement of the camshaft changes the axial position of a point on the cam surface with respect to the valve to change the valve lift amount, wherein the axial drive mechanism changes the rotational phase position of the camshaft with respect to the output shaft in response to the axial movement of the camshaft to change the valve timing;

a first detection element located on the camshaft and extending generally in the axial direction of the camshaft, wherein the first detection element is arranged to extend along a path that is different from the path of movement followed by a point on the cam when the camshaft is moved by the axial drive mechanism;

a second detection element located on the camshaft and extending generally in the axial direction of the camshaft, wherein the second detection element is arranged to extend along a path that corresponds to the path of movement followed by a point on the cam when the camshaft is moved by the axial drive mechanism;

a pulser arranged to face the camshaft, wherein the pulser produces a first pulse and a second pulse in response to the first detection element and the second detection element passing by the pulser, respectively, when the camshaft rotates;

a computer for computing the axial position and the rotational phase position of the camshaft based on the time period from the time at which the pulser produces the second pulse to the time at which the pulse produces the first pulse; and a controller for controlling the axial drive mechanism based on the axial position and the rotational phase position of the camshaft computed by the computer to move the camshaft to a desired axial position and a desired rotational phase position.

13. The apparatus according to claim 12, wherein the second detection element and the first detection element are symmetrical with respect to a plane passing through the axis of the camshaft.

14. A valve control apparatus for an internal combustion engine, the engine including a valve for opening and closing a combustion chamber, wherein the valve is actuated with a variable valve performance including a variable valve lift amount and a variable valve timing, the apparatus comprising:

a camshaft;

a cam provided on the camshaft for integrally rotating with the camshaft to selectively open and close the valve, wherein the cam has a cam surface for slidably contacting the valve, the cam surface having a profile that varies in the axial direction of the camshaft;

an axial shift mechanism for shifting the cam axially to change the valve performance, wherein axial shifting of the cam changes the profile that is in effect;

a first and a second detection element formed on the camshaft extending in a nonparallel manner;

a pulser arranged to face the detection elements, the pulser generating a first and second pulse in response to the first and second detected elements passing by the pulser when the camshaft rotates;

a computer for computing the axial position of the cam based on a corresponding change of time when the first pulse is generated as measured from the time when the second pulse is generated, wherein the computer determines a target axial position of the cam based on the engine operating status and the computed axial position of the cam; and a controller for controlling the axial drive mechanism based on the target axial position of the cam computed by the computer.

15. The apparatus as set forth in claim 14 further comprising:

an output shaft provided in the engine for driving the camshaft; and a reference pulser arranged to face the output shaft, the reference pulser generating a reference pulse in response to the rotation of the output shaft, wherein the axial shift mechanism shifts the rotational phase of the camshaft with respect to the output shaft, wherein the computer computes the rotation phase of the camshaft based on a corresponding change of time when the second pulse is generated as measured from the time when the reference pulse is generated, wherein the computer further determines a target rotational phase of the camshaft based on the engine operating status and the computed rotational phase of the camshaft, and wherein the controller further controls the phase changing mechanism based on the target rotational phase of the camshaft computed by the computer.

* * * * *